US005243568A

United States Patent [19]

Burch et al.

[11] Patent Number: 5,243,568

[45] Date of Patent: Sep. 7, 1993

[54] BIOCLOCK

[76] Inventors: Nancy Burch, 4044 SW. 4th St., Plantation, Fla. 33317; Mark Parent, 1915 SW. 21 Ave., Ft. Lauderdale, Fla. 33312

[21] Appl. No.: 817,376

[22] Filed: Feb. 18, 1992

[51] Int. Cl.[5] ..... G04B 23/02; G04B 19/00; G04C 21/16

[52] U.S. Cl. ..... 368/73; 368/79; 368/245; 368/256

[58] Field of Search ..... 308/72-74, 308/79, 250, 256, 10

[56] References Cited

U.S. PATENT DOCUMENTS

| | | | |
|---|---|---|---|
| 3,631,450 | 12/1971 | Chalfant | 368/250 |
| 3,727,395 | 4/1973 | Baylor | 368/256 |
| 5,008,865 | 4/1991 | Shaffer et al. | 368/10 |

*Primary Examiner*—Vit W. Miska

[57] ABSTRACT

An electronic circuit, which, when inserted into a clock/radio, utilizes the time-setting mechanism and the audio system of the clock/radio, and which, in conjunction with a light sensor, causes both light and sound to start at low intensity and increase gradually together to full intensity.

5 Claims, 2 Drawing Sheets

BIOCLOCK

BACKGROUND OF INVENTION AND DESCRIPTION OF PRIOR ART

Some people have no trouble waking up by themselves at a desired time early in the morning. However, the majority of us find it difficult to wake up on a dark morning without some sort of mechanical awakening device.

For several years it has been recognized that the current methods of waking up from a deep sleep in order to get on with the day's work are just unacceptable. The most common mechanisms currently available for awakening sleeping people are buzzers, radios, snooze alarms, flashing lights, etc., all of which awaken the sleeping person with a shock due to sudden loud noise or sudden bright light. The detrimental effects of a sudden awakening could extend beyond mere early morning irritability to having an adverse effect on working efficiency during the entire day.

Research work on circadian rhythm in the human body has been led by Dr. Charles Czeisler of Harvard University. His work proves the importance of light in setting our biological clocks. His work has not, however, solved the problem of how to simulate a natural dawn in a dark bedroom.

Recently some inventors have tried to address the problem. Chalfant, U.S. Pat. No. 3,631,450 (1971) developed a machine which produces a harmonic tone of increasing intensity, but which does not deal with the important effect of light. Baylor, U.S. Pat. No. 3,727,395 (1973) and Shaffer, U.S. Pat. No. 5,008,865 (1991) have worked out ways to achieve a gradual increase of light intensity, one in which a clock causes the light to turn on, and the other in which the light causes an alarm to ring. Neither of these addresses the problem of creating a gradually increasing sound. All of this prior art does, however, indicate the interest of many people in improving the present modes of forced waking from a deep sleep.

BRIEF DESCRIPTION OF THE INVENTION

This invention is a device which awakens a sleeping person in a natural, gradual, and pleasant manner. It consists of an electronic circuit and alterations to an existing clock/radio which couples the function of the clock/radio with the function of an existing lamp. The new circuitry causes the lamp to come on at low intensity before the actual time that the sleeper wants to awaken. Over the next fifteen minutes, the light intensity increases gradually, and this gradually increasing light is sensed by a light sensor which is embedded into the case of the clock/radio and is connected to the sound system, thus causing the sound of the radio to increase gradually also. This combination of gradually increasing (and eventually sustained) light plus the gradually increasing and eventually sustained sound will awaken a sleeper gently, yet insistently.

DESCRIPTION OF A PREFERRED EMBODIMENT

Figure 1:
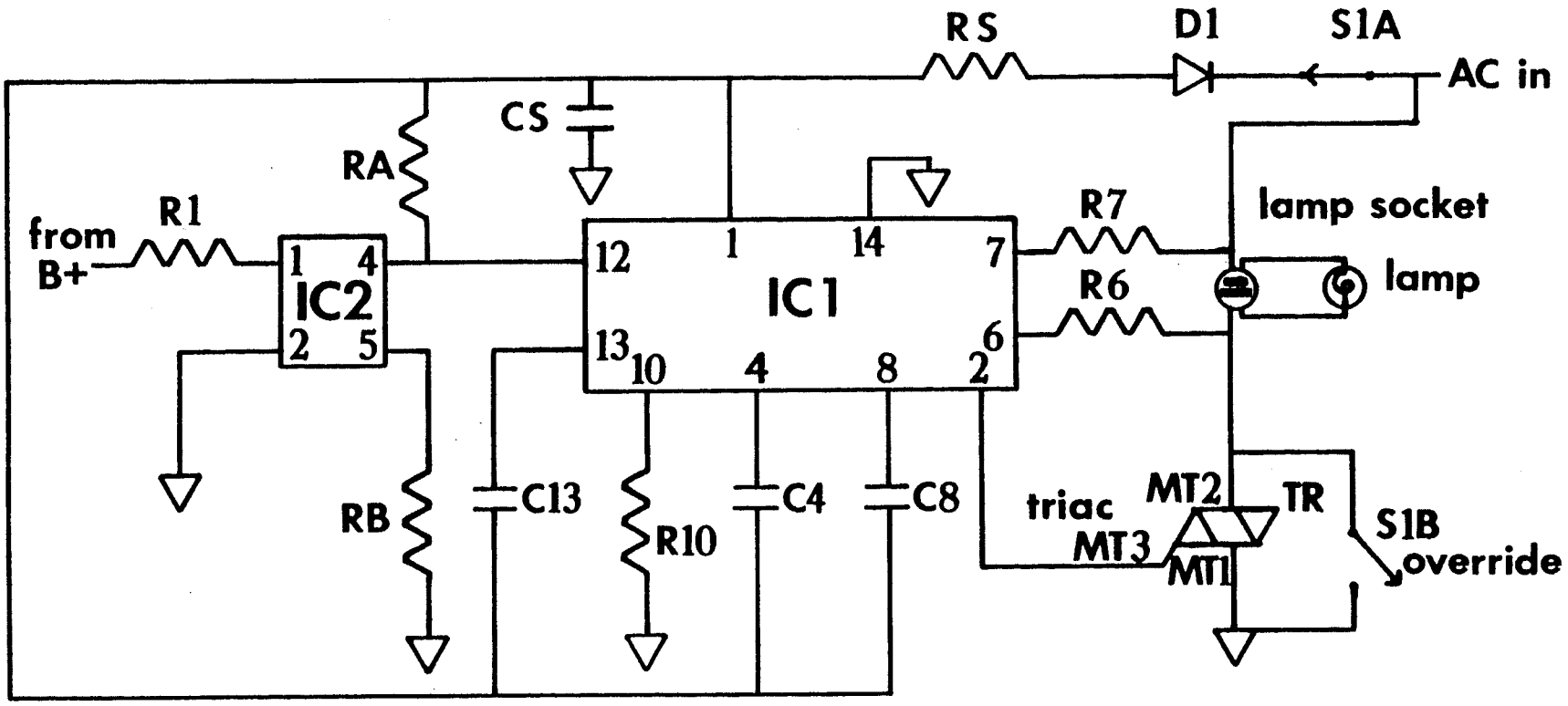
FIG. 1 is a schematic of the circuit which is inserted into a clock/radio.

The heart of the circuit (FIG. 1) is Integrated Chip IC1 TDA1185A, which is a triac phase angle controller used in a soft start configuration.

Figure 3:
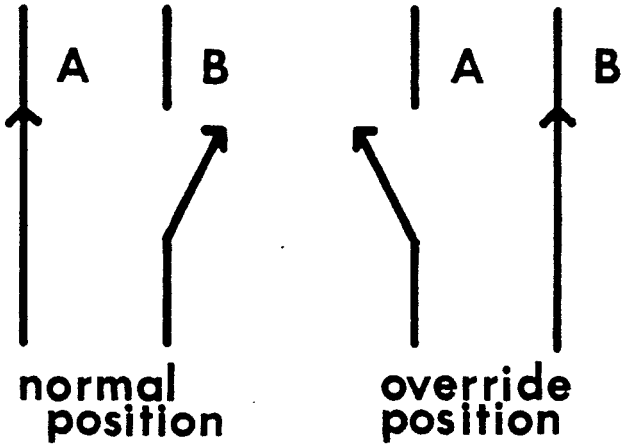
FIG. 3 is a diagram of an override switch which is mounted on the radio cabinet.

The DC supply is derived from the AC line through switch S1A (FIG. 3), rectifier D1, resistor RS, and filter capacitor CS to pin 1 of IC1. Pin 14 of IC1 is connected to ground.

The trigger pulse is connected to the triac TR from pin 2 of IC1, which is internally short-circuit protected. The pulse width is roughly proportional to resistor R10 (pin 10) and capacitor C4 (pin 4). Resistors R6 and R7 (at pins 6 and 7) prevent erratic operation. Capacitor C8 smooths out the voltage at pin 8. Capacitor C13 (pin 13) determines how fast the conduction angle reaches the set value, which is programmed at pin 12.

The radio's B+ voltage, which is present when the radio alarm goes off, is applied through resistor R1 to pin 1 of IC2, which is an opto-isolator. (Pin 2 of IC2 goes to ground) IC2 is a TIL 111 opto-isolator which, when turned on, completes the formation of the voltage divider network, consisting of RA and RB through internal connections at pins 4 and 5 of IC2, thus programming IC1 at pin 12.

Figure 2:
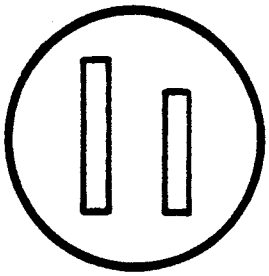
FIG. 2 is a diagram of an ordinary socket which is mounted on the radio cabinet.

The lamp is electrically inserted into the MT2 circuit of the triac TR using an ordinary socket (FIG. 2) which is physically located on the radio cabinet. Switch S1B (FIG. 3) is used as a bypass for normal lamp operation or use. This is also physically mounted on the radio cabinet.

Figure 4:
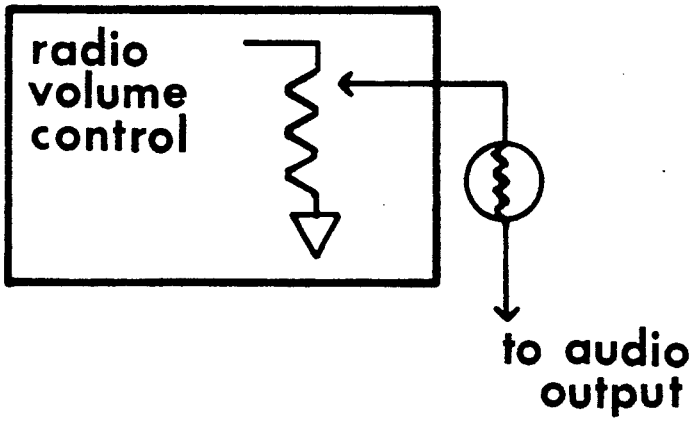
FIG. 4 is a diagram of a light sensor which is embedded in the radio cabinet.

Finally, a light-sensitive resistor (FIG. 4) is inserted into the center tap circuit of the radio volume control, thereby increasing sound volume proportionally to lamp intensity. This component is also physically mounted on the radio cabinet.

I claim

1. Electronic alarm device for use with a clock/radio producing an audio signal at a preset time and having volume control means for varying the volume of said audio signal comprising:

a lamp connected to said clock/radio and actuated thereby at said preset time;

means for gradually varying the intensity of said lamp for a time period after actuation thereof;

photo-sensitive means exposed to said lamp for providing a signal to the volume control means at said preset time to thereby gradually vary the volume of said audio signal proportionally to lamp intensity.

2. Electronic alarm device according to claim 1, wherein said photo-sensitive means is a photo-resistor.

3. Electronic alarm device according to claim 1, further comprising a socket outlet attached to said device for accommodating a plug of said lamp.

4. Electronic alarm device according to claim 1, wherein said means for gradually varying the intensity of said lamp causes the intensity of the lamp to increase gradually from low intensity to full intensity.

5. Electronic alarm device according to claim 1, wherein said means for gradually varying the intensity of said lamp comprises a triac and a phase angle controller for generating trigger pulses to said triac.

* * * * *